US005884908A

United States Patent [19]

Kato

[11] Patent Number: 5,884,908

[45] Date of Patent: Mar. 23, 1999

[54] SHEET-SUPPLY DEVICE

[75] Inventor: Hiroyuki Kato, Nagoya, Japan

[73] Assignee: Brother Kogyo Kabushiki Kaisha, Nagoya, Japan

[21] Appl. No.: 823,202

[22] Filed: Mar. 24, 1997

[30] Foreign Application Priority Data

Mar. 29, 1996 [JP] Japan ..... 8-077053

[51] Int. Cl.[6] ..... B65H 3/06

[52] U.S. Cl. ..... 271/119; 271/121; 271/127

[58] Field of Search ..... 271/119, 120, 271/121, 124, 127

[56] References Cited

U.S. PATENT DOCUMENTS

| | | | |
|---|---|---|---|
| 5,026,042 | 6/1991 | Miller . | |
| 5,527,629 | 6/1996 | Bortolotti et al. | 271/121 |
| 5,582,399 | 12/1996 | Sugiura | 271/121 |
| 5,697,603 | 12/1997 | Rato | 271/119 |
| 5,711,519 | 1/1998 | Bortolotti | 271/119 |

FOREIGN PATENT DOCUMENTS 7-81786 3/1995 Japan .

*Primary Examiner*—H. Grant Skaggs
*Attorney, Agent, or Firm*—Oliff & Berridge, PLC

[57] ABSTRACT

A sheet-supply device including: a hopper for supporting a stack of sheets on a surface thereof and including a sheet guide for aligning a side of the stack of sheets into alignment with a sheet-feed direction; a rotational shaft disposed confronting the hopper and extending in an axial direction perpendicular to the sheet-feed direction; a first sheet-feed roller and a second sheet-feed roller provided on the rotational shaft and for abutting a surface of an uppermost sheet of the stack of sheets so that rotation of the first sheet-feed roller and the second sheet-feed roller feeds the uppermost sheet in the sheet-feed direction, the first sheet-feed roller being disposed nearer the sheet guide than is the second sheet-feed roller; and a first collar and a second collar provided freely rotatable around the rotational shaft, the first collar being positioned substantially centered between the pair of sheet-feed rollers, the second collar being disposed between the first collar and the first sheet-feed roller.

20 Claims, 3 Drawing Sheets

SHEET-SUPPLY DEVICE

BACKGROUND OF THE INVENTION

1. Field of the Invention

The present invention relates to a sheet-feed device for using sheet-feed rollers to feed one sheet at a time from a stack of sheets in a hopper.

2. Description of the Related Art

Japanese Laid-Open Patent Application No. HEI-7-81786 and U.S. Pat. No. 5,026,042 describe a sheet-supply device used in a printer. The sheet-supply device includes a sheet-feed roller and a collar disposed on the same rotational shaft. The sheet-feed roller appears is substantially circular when viewed from the side, except for an arch-shaped cut-out portion removed from its periphery. The collar is disk shaped and has a radius smaller than that of greatest radius of the sheet-feed roller, but greater that the radius at the arch-shaped cut-out portion. Therefore, when the rotation of the sheet-feed roller brings the arch-shaped cut-out portion into confrontation with a sheet, the collar comes into contact with the sheet so that the sheet is prevented from rising up. By preventing the sheet from rising up, problems that often occur when feeding sheets from a stack in the hopper, such as skipping sheets or redundant sheet supply, that is, supplying two or more sheets stacked together, can be prevented.

SUMMARY OF THE INVENTION

However, the present inventor has determined that certain distances and positional relationships between sheet-feed rollers and collars in the axial direction of the rotational shaft can increase the frequency of sheet-supply problems, such as redundant sheet supply, that is, the number of times more than one sheet is supplied at the same time, or crooked sheet supply, that is, the number of times sheets are supplied with an undesirable tilt, thereby undermining the beneficial effects of the collar.

The positioning of collars is particularly difficult in sheet-supply devices wherein sheets are stacked with one edge aligned with a reference edge of the hopper. Although the collar is most effective when positioned at the center of a sheet, in such sheet-supply devices, the center position of the sheet will vary with the width of the sheet presently being supplied.

It is an objective of the present invention to overcome the above-described problems and to provide a sheet-supply device with appropriate positioning of sheet-feed rollers and collars in the axial direction of the rotation shaft on which they are disposed.

In order to achieve the above-described objectives, a sheet-supply device according to the present invention includes: a hopper for supporting a stack of sheets on a surface thereof and including a sheet guide for aligning a side of the stack of sheets into alignment with a sheet-feed direction; a rotational shaft disposed confronting the hopper and extending in an axial direction perpendicular to the sheet-feed direction; a first sheet-feed roller and a second sheet-feed roller provided on the rotational shaft and for abutting a surface of an uppermost sheet of the stack of sheets so that rotation of the first sheet-feed roller and the second sheet-feed roller feeds the uppermost sheet in the sheet-feed direction, the first sheet-feed roller being disposed nearer the sheet guide than is the second sheet-feed roller; and a first collar and a second collar provided freely rotatable around the rotational shaft, the first collar being positioned substantially centered between the pair of sheet-feed rollers, the second collar being disposed between the first collar and the first sheet-feed roller.

With this configuration, not only does the first collar press against the sheet at the position central between the pair of sheet-feed rollers, but the second collar, which is disposed nearer the sheet guide than the first collar, also presses against the sheet. Therefore, a highly reliable sheet feed device capable of feeding both wide and narrow sheets with fewer sheet feed misses, such as sheets being fed tilting at an angle and more than one sheet being fed at a time, which can occur when sheets lift up away from the pressing-up plate.

According to another aspect of the present invention, a second collar and a third collar press sheets from both sides of the first sheet-feed roller, thereby further preventing sheets from lifting up near the first sheet-feed roller.

According to another aspect of the present invention, a second sheet-feed roller is disposed further from the sheet guide than is the first sheet-feed roller. A fourth and fifth collars are disposed on either side of the second sheet-feed roller so that sheets are pressed down thereby and prevented from rising up near the second sheet-feed roller.

According to another aspect of the present invention, the first collar is disposed at a position separated from the sheet guide by a distance equal to or less than the width of the smallest sheet usable in the printer. With this configuration, the first collar will reliably press down sheets with the minimum width usable in the sheet-supply device.

According to another aspect of the present invention, the sheet guide and the first collar are separated by a distance matching a width of a standard sheet and the sheet guide and the second sheet-feed roller are separated by a distance matching a length of the standard sheet. By contacting a standard-sized sheet using sheet-feed rollers and collars positioned in this way, redundant sheet feed and sheets being fed at an angle can be prevented. This configuration is particularly effective in preventing redundant feed and tilted feed of post cards.

A means can be provided for increasing coefficient of friction between an uppermost sheet and a pressing-up plate of the hopper at positions corresponding to the first and second sheet-feed rollers and the first and second collars. Because the means is disposed at a position where pressing force of the pressing plate operates linearly on the sheet-feed roller and collars, a large friction force operates between the lowest sheet in the hopper and the pressing-up plate. Therefore, redundant sheet feed can be effectively prevented even when only a few sheets remain in the hopper.

According to another aspect of the present invention, a sheet-supply device includes: a hopper for supporting a stack of sheets; a rotational shaft disposed in confrontation with the hopper; a pair of sheet-feed rollers disposed on the rotational shaft and for abutting a surface of an uppermost sheet of the stack and feeding the uppermost sheet in a sheet-feed direction; and a plurality of collars freely rotatable around the rotational shaft and disposed between the sheet-feed rollers and nearer the sheet-feed rollers than to each other. Because the collar disposed near the pair of sheet-feed rollers presses the sheets down, erroneous sheet feed caused by the sheets lifting up can be prevented.

The sheet feed device according to the present invention is very suitable for use in an ink jet printer. An ink jet printer provided with the sheet-supply device of the present invention is highly reliable and has few printing mistakes caused by poor sheet supply of sheet because the sheet-supply device has excellent sheet feed performance.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
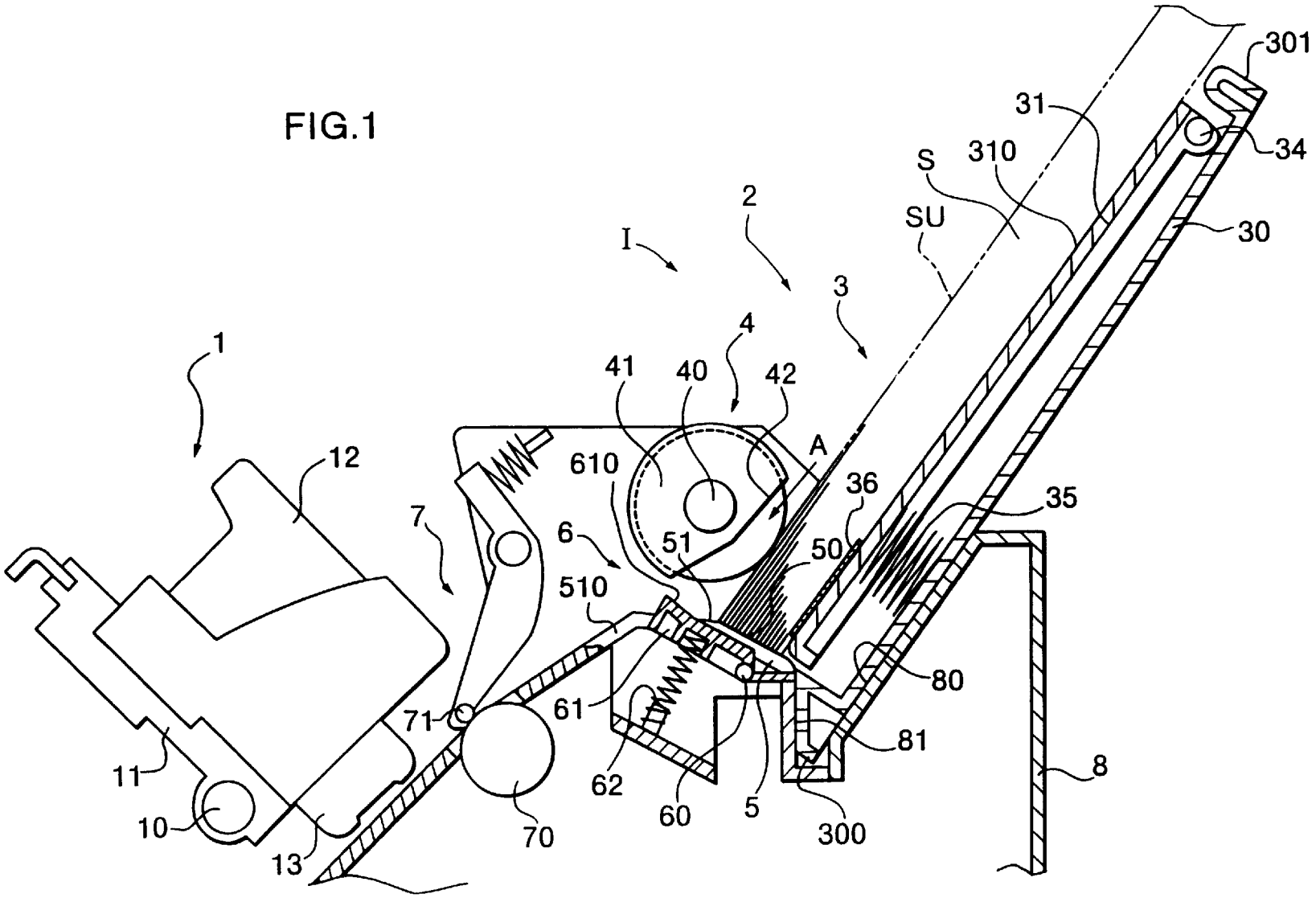
FIG. 1 is a side view in partial cross section showing a sheet-supply device according to the present invention.

A sheet-supply device according to a preferred embodiment of the present invention will be described while referring to the accompanying drawings wherein like parts and components are designated by the same reference numerals to avoid duplicating description.

As shown in FIG. 1, an ink jet printer according to the present embodiment includes: a print mechanism 1 for performing predetermined printing operations on a sheet; and a sheet-supply device 2 for supplying one sheet SU at a time from a stack of sheets S to the print mechanism 1. The sheets S are cut sheets, which are each formed in a rectangular shape with fixed dimensions.

The print mechanism 1 includes: a guide rail 10; a carriage 11 reciprocally movable following the guide rail 10; and a print head 13 supported with an ink cartridge 12 on the carriage 11. The guide rail 10 is disposed extending in a direction parallel to the surface of the sheets S and orthogonal to a sheet-feed direction of the sheet SU supplied from the sheet-supply device 2. Although the sheet-feed direction of the sheet SU changes as the sheet SU is fed toward the print mechanism 1, it will be assumed that, unless otherwise noted, the sheet-feed direction will refer to the direction of a sheet SU supplied from a hopper 3 as represented by an arrow A in FIG. 1.

While the carriage 11 is reciprocally driven by a drive source, such as a motor not shown in the drawings, the print head ejects ink droplets towards the sheet SU passing therebeneath, thereby printing characters and figures on the sheet SU.

The sheet-supply device 2 includes: the hopper 3 containing stacked sheets S including an uppermost sheet SU; a sheet-feed mechanism 4 for feeding the sheet SU from the hopper 3; a wall portion 5 where sheets S stacked in the hopper 3 abut in the sheet-feed direction; a stopper mechanism 6 provided on the wall portion 5; and a transport mechanism 7 for transporting the sheet SU directly beneath the print head 13. The transport mechanism 7 is positioned downstream in the sheet-feed direction from the wall portion 5.

Figure 2:
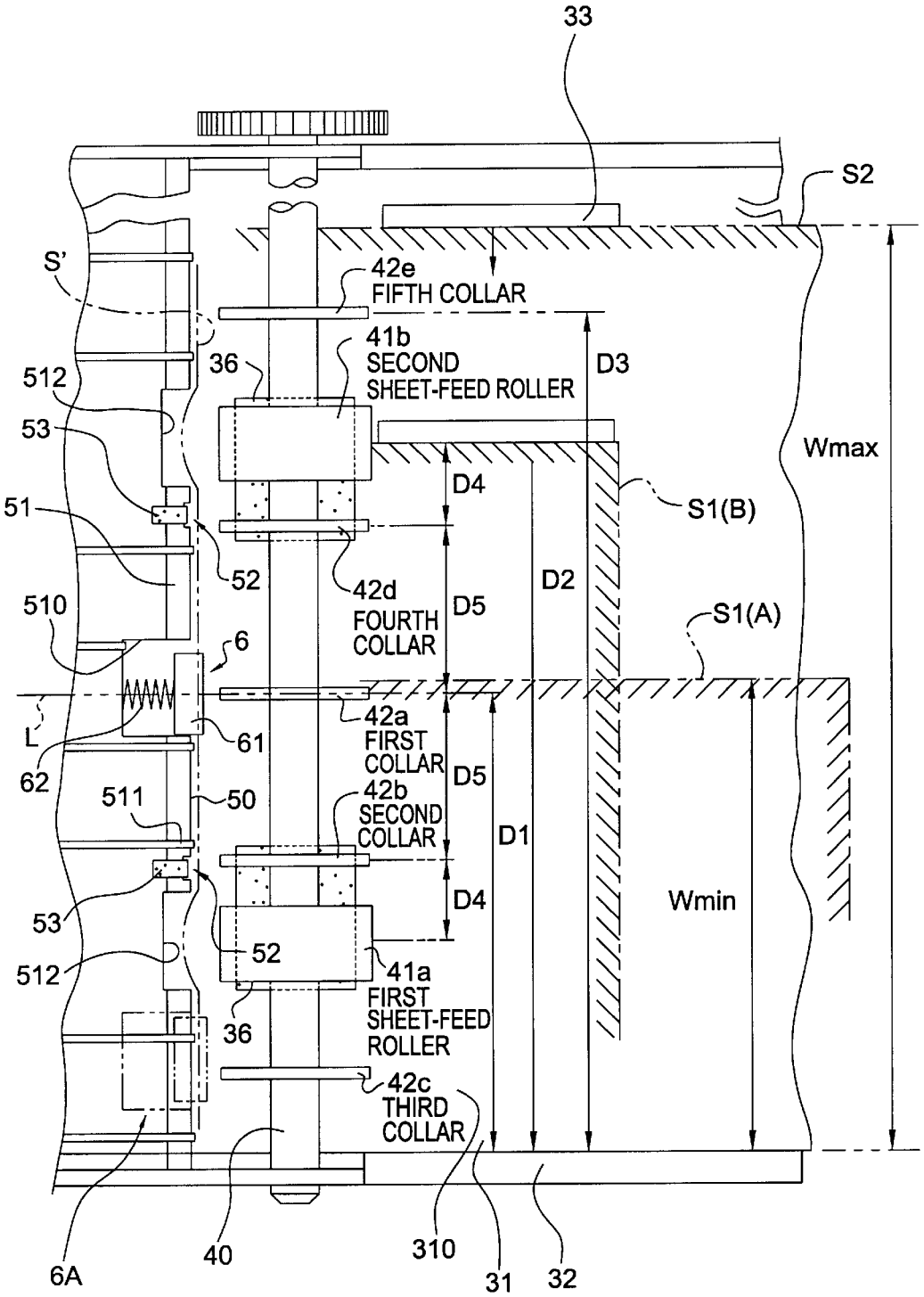
FIG. 2 is a plan view showing the sheet-supply device of FIG. 1.

The hopper 3 includes a sheet cassette 30, which is detachable with respect to the printer. Cassette receiving surfaces 80, 81 formed in a print frame 8 support the sheet cassette 30 at its front edge 300 near the discharge edge of the sheets S so that the sheet cassette 30 tilts at an angle. A pressing-up plate 31 is provided to the interior of the sheet-supply cassette 30. Sheets S are stacked at the upper surface 310 of the pressing-up plate 31. As shown in FIG. 2, a pair of sheet guides 32, 33 for sandwiching the sheet in the vertical direction of FIG. 2 are provided near opposite edges of the pressing-up plate 31. The first sheet guide 32 is fixed in place and the second sheet guide 33 is freely movable in the vertical direction of FIG. 2 so that the first and second guides 32, 33 can sandwich a variety of different sheets with different dimensions therebetween.

First, sheets stacked on the pressing-up plate 31 are aligned so that one edge is aligned parallel with the sheet-feed direction by abutting the edge against the first sheet guide 32. Then, the sheets aligned against the first sheet guide 32 are pressed from the opposite edge by the second sheet guide 33. Accordingly, sheets S contained in the hopper 3 are supported at a fixed position at the side abutted by the first sheet guide 32 regardless of the width of the sheet. It should be noted that the first sheet guide 32 can be provided so as to enable adjusting its position somewhat in the vertical direction of FIG. 2. Alternatively, a supplementary sheet guide can be provided in addition to the first sheet guide 32 in accordance with the width of the sheet. For example, although the sheet guide 33 is fixed in a slide mount in the present embodiment, a detachable giude member could be provided instead. In this case also, the sheets S are positioned based on the reference of the first sheet guide 32 and then the position of the second sheet guide 33 is adjusted according to the width of the sheet.

As shown in FIG. 1, the pressing-up plate 31 is pivotably rotatable around a pivot shaft 34 provided at the upper edge 301 of the sheet-supply cassette 30. A spring 35 is provided for urging the pressing-up plate 31 toward the sheet-feed mechanism 4. With this configuration, the front edge of the sheet SU is pressed toward the sheet-feed mechanism 4. It should be noted that the pivot shaft 34 is disposed so as to extend perpendicular to the sheet-feed direction and parallel with the surface of the sheets S. The pressing-up plate 31 is formed from, for example, a resin material and has a relatively small coefficient of friction at its exposed upper surface 310. Accordingly, friction resistance between the lowest sheet in the hopper 3 and the upper surface 310 of the pressing-up plate 31 is smaller than friction resistance between the stacked sheets S. Therefore, when only a few sheets, for example two or three sheets, remain in the hopper, there is a danger that all of the remaining sheets S will slide over the upper surface 310 of the pressing-up plate 31 and be fed out at the same time. To prevent the lowest sheet in the hopper 3 from being drawn out with the uppermost sheet SU in this case, a friction member 36 is attached to the upper surface 310 of the pressing-up plate 31. The friction members 36 can be made of, for example, cork.

As shown in FIGS. 1 and 2, the sheet-feed mechanism 4 includes: a support shaft 40 extending perpendicular to the sheet-feed direction and parallel with the surface of the sheets S; a pair of sheet-feed rollers 41*a*, 41*b* attached to the support shaft 40 and separated by a predetermined distance; and five collars 42*a*, 42*b*, 42*c*, 42*d*, and 42*e* rotatably provided on the support shaft 40 and separated by predetermined distances. The sheet-feed rollers 41*a*, 41*b* will be referred to collectively as the sheet-feed rollers 41 when there is no need to distinguish between them. Similarly, the collars 42*a* through 42*e* will be referred to collectively as the collars 42 when there is no need to distinguish between them.

Figure 3:
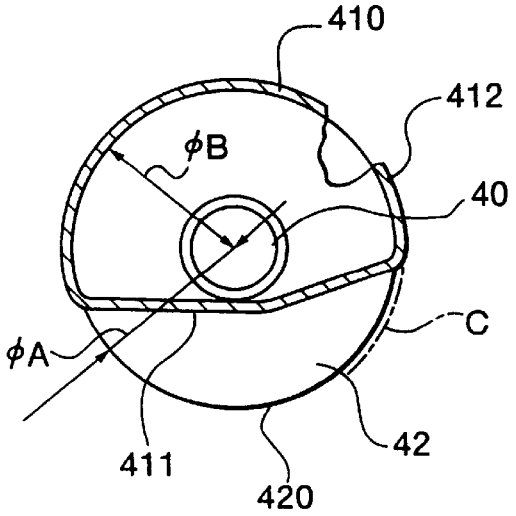
FIG. 3 is a side view in partial cross section showing a sheet-feed roller and a collar of the sheet-supply device of FIG. 1.

The support shaft 40 is rotatable in both counterclockwise and clockwise directions as viewed in FIG. 1 by a drive source (not shown in the drawings). As shown in FIG. 3, each sheet-feed roller 41 includes: a curved peripheral portion 410 aligned on an imaginary circle C centered on the same axis as the axis of the support shaft 40; and a bowed portion 411 receded from the imaginary circle C in the radial direction toward the support shaft 40. The sheet-feed rollers 41 are integrally rotatable with the support shaft 40. A friction member 412 formed from rubber, for example, for increasing the coefficient of friction of the sheet-feed rollers 41 is provided covering the outer periphery of the peripheral portion 410 and the bowed portion 411. The peripheral portion 410 is formed with a peripheral length necessary for feeding out the sheet SU to between a slave roller 71 and a transport roller 70 of the transport mechanism 7 shown in FIG. 1.

As also shown in FIG. 3, the collars 42 are formed in a circular disk shape having an outer peripheral surface 42 with a fixed rate of curvature. The collars 42 are provided freely rotatable with respect to the support shaft 40. The collars 42 are formed with a radius ϕ A smaller than a maximum radius ϕ B of the peripheral portion 410, that is, including the friction member 412 of the sheet-feed rollers 41. Said differently, the collars 42 have a diameter smaller than the diameter of the imaginary circle C, on which is aligned the outer peripheral portion 410. Also, the outer peripheral surface 420 of the collars 42 are positioned further out in the radial direction than the bowed portion 411 of the sheet-feed rollers 41. For this reason, when the support shaft 40 rotates in the clockwise direction until the peripheral portion 410 of the sheet-feed rollers 41 confronts the hopper 3, then the uppermost sheet SU, which is the hopper 3 is pressed upward out of the hopper 3 by the pressing-up plate 31, will be pressed against the outer peripheral surface of the peripheral portion 410 of the sheet-feed rollers 41. As rotation of the sheet-feed rollers 41 continues, the bowed portion 411 will turn into confrontation with the hopper 3 so that the sheet SU still remaining in the hopper 3, that is, the portion of the uppermost sheet SU not yet fed out by the peripheral portion 410, will abut against the outer peripheral surface of the collars 42. With this configuration, after the sheet-feed rollers 41 complete separation and feed of the sheet SU, the collars 42 will maintain a distance between the sheet-feed rollers 41 and the sheet being fed out while rotating in association with the movement of the sheet SU as the sheet SU is transported by the transport mechanism 7. In this way, the sheets S stacked in the hopper 3 can be prevented from lifting up until feed of the next sheet SU is started. As a result, redundant sheet feed, that is, the problem of more than one sheet being fed at a time which is caused by sheets S lifting up, can be prevented.

The radius ϕ A of the collars 42 is set to between 94% to 97% of the radius ϕ B of the sheet-feed rollers 41. When set to less than 94%, the pressing-up plate 31 will pivot to too great an extent toward the collars 42 when the sheet SU switches from contacting the sheet-feed rollers 41 to contacting the collars 42. This shock can lead to more than one of the sheets S being drawn out from the front edge of the hopper 3 at a time. On the other hand, when the radius ϕ A is set to greater than 97%, when the sheet-feed rollers 41 contact the sheet SU, the collars 42 prevent the sheet-feed rollers 41 from deforming sufficiently in the radial direction. As a result, friction between the sheet-feed rollers 41 and the sheet SU will be insufficient so that insufficient force is provided for feeding the sheet SU. The collars 42*a* through 42*e* can be set to radii ϕ A of different length or the same length as long as the length of the radius ϕ A is within the range described above.

Table 1 indicates experimental results observed in a supply condition of the sheet when the radius ϕ B of the sheet-feed rollers 41 is set to 32.5 mm and the radius ϕ A of the collars 42 is varied.

TABLE 1

| COLLAR RADIUS (mm) | | 30.0 | 30.5 | 31.0 | 31.5 | 32.0 |
|---|---|---|---|---|---|---|
| THICK SHEET (POST CARD) | EMPTY TRANSPORT | OK | OK | OK | OK | OK |
| | REDUNDANT TRANSPORT | OK | OK | OK | OK | NG |
| THIN SHEET | EMPTY TRANSPORT | NG | OK | OK | OK | OK |
| | REDUNDANT TRANSPORT | OK | OK | OK | OK | OK |

(OK = SHEET FEED WAS RELIABLY PERFORMED;
NG = SHEET FEEDING WAS UNRELIABLY PERFORMED)

Empty transport, that is, when the sheet-feed rollers 41 rotate without transporting a sheet, was observed in thick sheets, such as post cards when the external radios ϕ A of the collars 42 was set to 32 mm. Redundant transport, that is, when more than one sheet was transported at the same time, was observed in thin sheets when the external radios ϕ A of the collars 42 was set to 30 mm.

As shown in FIG. 2, the collars 42 include: a first collar 42*a* disposed at a position centered on an imaginary line L between the pair of sheet-feed rollers 41; a second collar 42*b* disposed at a position between the first collar 42*a* and the first sheet-feed roller 41*a*, which is nearer to the first sheet guide 32 than the second sheet-feed roller 41*b*; a third collar 42*c* disposed nearer to the first sheet guide 32 than is the first sheet-feed roller 41*a*, that is, disposed between the first sheet guide 32 and the first sheet-feed roller 41*a*; a fourth collar 42*d* disposed between the first collar 42*a* and the second sheet-feed roller 41*b*, which is further from the first sheet guide 32 than is the first sheet-feed roller 41*a*; and a fifth collar 42*e* disposed further from the first sheet guide 32 than is the second sheet-feed roller 41*b*. The first sheet guide 32 and the first collar 42*a* are separated by a distance D1, which is the same length or shorter than a minimum width Wmin of the narrowest sheet width usable by the printer. Accordingly, as shown in FIG. 2, when a smallest sheet S1 (indicated by hatching A in FIG. 2) with the minimum width Wmin is mounted so that its lengthwise edges are aligned with the feed direction of the sheet S1, the smallest sheet S1 will be contacted by the first sheet-feed roller 41*a* and three of the collars, that is, the first through third collars 42*a* through 42*c*. One example of the smallest sheet S1 is a 100 mm×148 mm post card, but other examples are possible.

The first sheet guide 32 and the second sheet-feed rollers 41*b* are separated by a distance D2, which is same or slightly smaller than the longest dimension of the smallest sheet S1 described above. Accordingly, when, as indicated by hatching B in FIG. 2, the smallest sheet S1 is mounted with its widthwise edges aligned with the sheet feed direction, the sheet S1 will be contacted by the first and the second sheet-feed rollers 41*a* and 41*b* and also by four of the collars, that is, the first through fourth collars 42*a* through 42*d*.

The first sheet guide 32 and the fifth collar 42*e* are separated by a distance D3, which is slightly shorter than a maximum width Wmax of the largest sheet width usable in the printer. Accordingly, when a largest sheet S2 having the maximum width Wmax is mounted in the sheet supply device, the sheet S2 will be contacted by the first and the second sheet-feed rollers 41*a* and 41*b* and all five of the collars 42, that is, the first to fifth collars 42*a* through 42*b*. Examples of the largest sheet S2 having the maximum width Wmax are a 210 mm×297 mm A4 sheet and 216 mm×279 mm letter sheet. In these cases, the width maximum Wmax would be the shortest dimension of the A4 sheet and of the letter sheet.

Of the three collars 42*a*, 42*b*, and 42*c* sandwiched between the sheet-feed rollers 41*a*, 41*b*, the second collar 42*b* is separated from the first sheet-feed roller 41*a*, and the fourth collar 42*d* is separated from the second sheet-feed roller 41*b*, by a distance D4. The adjacent collars 42*a*, 42*b*, and 42*d* are disposed equidistant from each other and separated by a distance D5, which is longer than the distance D4. When the sheet SU is pressed down near the sheet-feed rollers 41*a*, 41*b* in this way, then redundant feed of sheets S can be effectively prevented. Also, the third collar 42*c* and the fifth collar 42*e* press the largest sheet S2 from opposite sides of the sheet-feed rollers 41*a*, 41*b* with respect to the collars 42*b*, 42*d*, thereby effectively preventing the largest S2 sheet from lifting up. In this way also, redundant supply of sheets can be effectively prevented. The third collar 42*c* is separated from the first sheet-feed roller 41*a*, and the fifth collar 42*e* is separated from the second sheet-feed roller 41*b*, by a distance greater than the distance D4.

Further, one of the two friction members 36 of the pressing-up plate 31 is provided at a region confronting the first sheet-feed roller 41*a* and the third collar 42*c* and the other at a region confronting the second sheet-feed roller 41*b* and the fourth collar 42*d*. The urging force of the spring 35 presses the pressing-up plate 31 in a linear direction in which the friction members 36 are aligned with corresponding ones of the sheet-feed rollers 41*a*, 41*b* and the collars 42*b*, 42*d*. This increases the separating effects of the friction member 36 against the sheet SU. It should be noted that in the example shown in the figures, distances D1 through D5 are determined using distances from the widthwise center of the sheet-feed rollers 41 and collars 42.

As shown in FIG. 1, the wall portion 5 is integrally formed with the printer frame 8. As shown in detail in FIG. 4, a sheet receiving surface 50 and a slanting surface 51 are formed in the wall portion 5. The sheet receiving surface 50 receives and stops sheets S when a user stacks the sheets S in the hopper 3 from the upper edge of the sheet-supply cassette 30. The slanting surface 51 slants in the direction in which the sheets S are to be fed when separated away from the sheet-supply cassette 30. Sheets S pass around the wall portion 5 when fed out of the sheet-supply cassette 30 toward the transport mechanism 7. It should be noted that in order to reduce friction, the slanting surface 51 could be formed in a curved shape and provided with protrusion portions 511 extending along the surface of the slanting surface 51 in the direction in which sheets S are to be fed.

Figure 4:
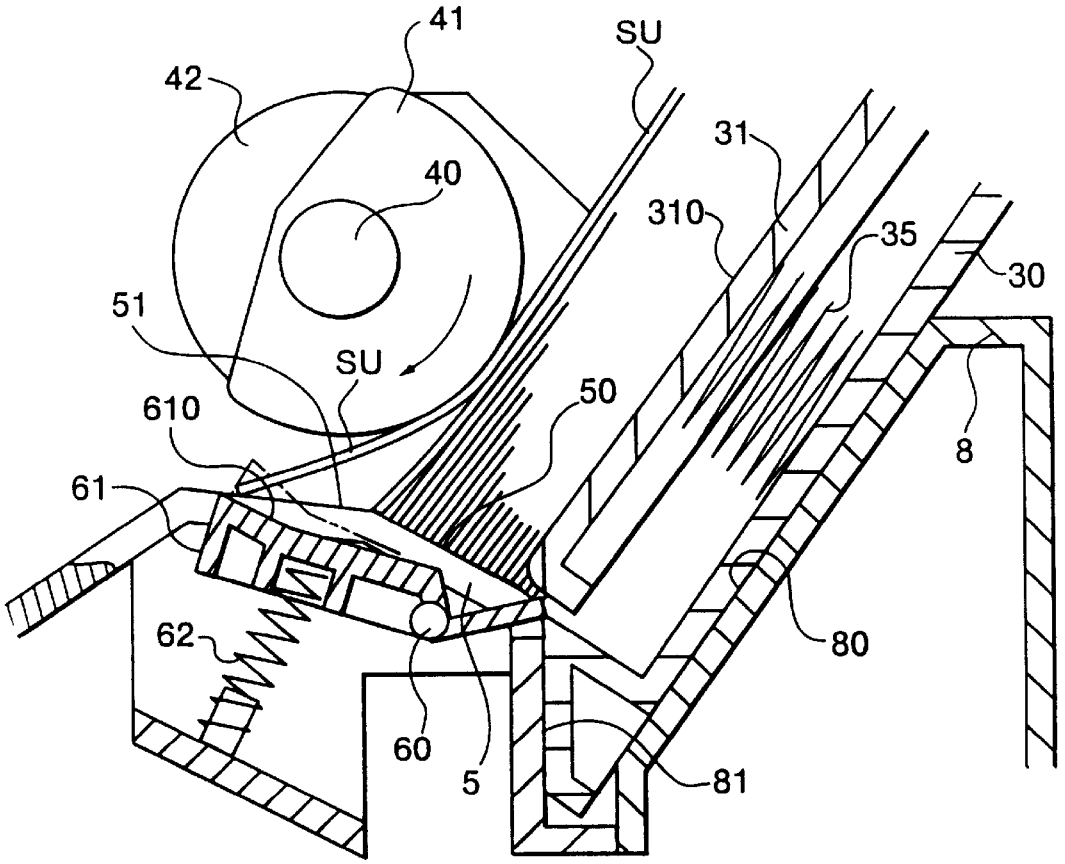
FIG. 4 is an enlarged view of FIG. 1 showing essential portions of the sheet-supply device.

As shown in FIG. 2, a cut-out hole 510 is provided in the slanting surface 51. A stopper mechanism 6 is disposed within the cut-out hole 510. As shown in FIG. 1, the stopper mechanism 6 includes: a pivotal shaft 60, a stopper 61 pivotably supported on the pivotal shaft 60, and a coil spring 62 urging the stopper 61 toward the hopper 3. The rotational shaft 60 is provided at the base of the hopper 3 so as to extend perpendicular to the sheet-feed direction and parallel to the surface of the sheets S. The stopper 61 pivots around the pivotal shaft 60 so as to protrude from the slanting surface 51 toward the first collar 42*a* and recede beneath the slanting surface 51 away from the first collar 42*a*. The rotational shaft 60 and the coil spring 62 are supported on the frame 8. In FIG. 4, the condition of the stopper 61 when protruding away from the slanting surface 51 is indicated by a two-dot chain line and the condition of the stopper 61 when receding below the slanting surface 51 in a solid line. The stopper 61 is formed from the same resin material as the printer frame 8 and is formed with a resiliency and a stiffness sufficiently high enough to maintain a fixed form against the pressing force of the sheets S when the sheets S abut against a contact surface 610. Also, as shown in FIG. 2, the stopper 61 is disposed centered on the central line L between the pair of sheet-feed rollers 41 with respect to an axial direction of the support shaft 40. As indicated by a two-dot chain line in FIG. 2, an additional stopper mechanism 6A can be provided between the first sheet-feed roller 41*a* and the first sheet guide 32.

As shown in FIG. 4, the sheet SU fed out from the sheet-supply cassette 30 first abuts and presses against the contact surface 610 of the stopper 61, then passes over the stopper 61 before traveling towards the transport mechanism 7. The amount that the stopper 61 is pressed by the sheet SU varies with the resiliency and stiffness of the sheet SU. For example, when the sheet SU is a post card, an envelope, or other thick and highly resilient sheet, the stopper 61 is pressed almost flush with the slanting surface 51. As a result, the sheet SU is fed while following the curved surface of the slanting surface 51. Because the slanting surface 51 has a small gradient, the sheet SU will slide over it with little resistance. Therefore, there is little danger of the sheet SU sticking to the slanting surface 51, and of the sheet-feed rollers 41 rotatingly sliding over the surface of the sheet SU without transporting it as a result. On the other hand, when the sheet SU is thin and therefore has slight resiliency, the spring 62 is barely compressed by the resiliency of the sheets. The sheet SU will therefore greatly bend at its front edge when it abuts against the stopper 61. This enhances separation between the sheet SU and the other sheets S. To prevent sliding rotation of the sheet-feed rollers 41 over the sheet SU, it is desirable that the friction force operating between the sheet-feed rollers 41 and the sheet SU be greater than the friction force between the sheet SU and the stopper 61.

As shown in FIG. 2, indentation portions 512 are formed in the slanting surface 51 at positions corresponding to the sheet-feed rollers 41 with respect to the sheet feed direction of the sheet SU. As shown by a dotted-chain line S' in FIG. 2, the front edge portion of the sheet SU pressed by the sheet-feed rollers 41 is deformed so as to bend into the indentation portions 512 and, at the substantial central position between the indentation portions 512, also in the opposite direction by the stopper 61. Separation of the sheet SU from the other sheets S is improved with this configuration.

A pair of groove portions 52 are formed in the wall portion 5 and aligned with the stopper 61 in the axial direction of the support shaft 40. A friction member 53 is adhered to each groove portion 52. The friction members 53 protrude from the groove portion 52 in the sheet feed direction so as to be exposed above the slanting surface 51. The friction members 53 increase the coefficient of friction at the slanting surface 51 to greater than the coefficient of friction at the contact surface of the stopper 61. With this configuration, the sheet SU will slide across stopper 61 more easily than across the slanting surface 51 so that separation of the sheet SU from the other sheets S at the slanting surface 51 is improved. To insure this beneficial effect is achieved when protrusion portions 511 are provided to the slanting surface 51, the friction members 53 are disposed with their exposed surface, that is, the surface exposed above the slanting surface 51, aligned to substantially to the same height as the upper surface of the protrusion portions 511. The exposed surface of the friction members 53 would become a source of resistance for thick sheets is set to a level higher than the surface of the protrusion portion 511, and would become a source of resistance for thin sheets if were set to a level lower than the surface of the protrusion portion 511.

The sheet SU, after passing the over the wall portion 5, is guided between the transport roller 70 and the slave roller 71 of the transport mechanism 7. However, before the sheet SU reaches the transport roller 70, as viewed in FIG. 2, clockwise rotation of the transport roller 70 is continued until the sheet SU is fed out a predetermined distance by the sheet-feed rollers 41. Then the transport roller 70 is driven to rotate in the counterclockwise direction as viewed in FIG. 2. In this way, the front edge of the sheet SU abuts against the transport roller 70 and is aligned in the axial direction of the transport roller 70 before being transported to the print mechanism 1.

While the invention has been described in detail with reference to specific embodiments thereof, it would be apparent to those skilled in the art that various changes and modifications may be made therein without departing from the spirit of the invention, the scope of which is defined by the attached claims.

For example, three or more sheet-feed rollers 41 can be provided. Also, the number of collars 42 can be varied as appropriate. Further, the present invention can be applied to any separation device for separating sheets S from each other and is not limited to the sheet supply device having the slanting surface 51 and the stopper 61 of the wall portion 5. Although in the sheet-supply device of the above-described embodiment, sheets S are aligned using a single edge of the hopper 3, the distances D4, D5 for positioning the pair of sheet-feed rollers 41*a*, 41*b*, and the collars 42*a*, 42*b*, 42*d* disposed therebetween, are not determined based on the single edge. Therefore, the present invention can be applied to a sheet-supply device in which, regardless of the sheet width, the center of sheets are always aligned with the center of the hopper. The sheet-supply device of the present invention is not limited to use in an ink jet printer, but can be used in any print device, such as a laser printer or other types of printers, copy machines or facsimile machines. The present invention can also be applied to a sheet-supply device which supports sheets in a horizontal posture rather than in a vertical posture.

What is claimed is:

1. A sheet-supply device comprising:

a hopper for supporting a stack of sheets on a surface thereof and including a sheet guide for aligning a side of the stack of sheets into alignment with a sheet-feed direction;

a rotational shaft disposed confronting the hopper and extending in an axial direction perpendicular to the sheet-feed direction;

a first sheet-feed roller and a second sheet-feed roller provided on the rotational shaft and for abutting a surface of an uppermost sheet of the stack of sheets so that rotation of the first sheet-feed roller and the second sheet-feed roller feeds the uppermost sheet in the sheet-feed direction, the first sheet-feed roller being disposed nearer the sheet guide than is the second sheet-feed roller; and a first collar and a second collar provided freely rotatable around the rotational shaft, the first collar being positioned substantially centered between the pair of sheet-feed rollers, the second collar being disposed between the first collar and the first sheet-feed roller.

2. A sheet-supply device as claimed in claim 1, further comprising a third collar disposed nearer the sheet guide than the first sheet-feed roller.

3. A sheet-supply device as claimed in claim 2, further comprising:

a fourth collar disposed between the second sheet-feed roller and the first collar; and a fifth collar disposed further from the sheet guide than the second sheet-feed roller.

4. A sheet-supply device as claimed in claim 3, wherein the sheet guide and the first collar are separated by a first distance matching a width of a smallest sheet usable in the sheet-supply device.

5. A sheet-supply device as claimed in claim 1, wherein:

the sheet guide and the first collar are separated by a first distance matching a width of a standard sheet; and the sheet guide and the second sheet-feed roller are separated by a second distance matching a length of the standard sheet.

6. A sheet-supply device as claimed in claim 5, wherein the standard sheet is a 100 mm by 148 mm postcard.

7. A sheet-supply device as claimed in claim 1, further comprising:

a fourth collar disposed between the second sheet-feed roller and the first collar; and a fifth collar disposed further from the sheet guide than the second sheet-feed roller.

8. A sheet-supply device as claimed in claim 7, wherein the hopper includes an upward pressing plate for pressing the sheet toward the sheet-feed rollers; and further comprising:

a means for increasing coefficient of friction between the sheet and the upward pressing plate, the means being disposed at a first region corresponding to the second collar and the first sheet-feed roller and at a second region corresponding to the second sheet-feed roller and the fourth collar.

9. A sheet-supply device as claimed in claim 7, wherein the first sheet-feed roller and the second collar are separated by a fourth distance and the first collar and the second collar are separated by a fifth distance, the fourth distance being shorter than the fifth distance.

10. A sheet-supply device as claimed in claim 9, wherein the second sheet-feed roller and the fourth collar are separated by the fourth distance and the first collar and the fourth collar are separated by the fifth distance.

11. A sheet-supply device as claimed in claim 10, wherein the second collar and the fourth collar are equidistant from the first collar.

12. A sheet-supply device as claimed in claim 7, wherein the first collar is centered between the first collar and the fourth collar.

13. A sheet-supply device as claimed in claim 1, wherein the sheet guide and the first collar are separated by a first distance matching a width of a smallest sheet usable in the sheet-supply device.

14. A sheet-supply device as claimed in claim 1, wherein the hopper includes an upward pressing plate for pressing the sheet upward toward the sheet-feed rollers; and further comprising:

a means for increasing coefficient of friction between the sheet and the upward pressing plate, the means being disposed at a region corresponding to the second collar and the first sheet-feed roller.

15. A sheet-supply device as claimed in claim 1, further comprising a print head disposed downstream from the sheet-supply device with regards to a sheet feed direction and for ejecting ink droplets toward the sheet.

16. A sheet-supply device as claimed in claim 1, wherein:

the first sheet-feed roller and the second sheet-feed roller are formed with a maximum radius; and the first collar and the second collar are formed with a radius having a length 95% to 97% of the maximum radius.

17. A sheet-supply device as claimed in claim 1, further comprising a wall portion formed at a front edge of the hopper with respect to the sheet-feed direction so that the uppermost sheet fed out by the sheet-feed rollers abuts against the wall portion, the wall portion including:

a slanting surface gradually slanting in the sheet-feed direction with increasing distance from the surface of the hopper; and indentation portions formed at positions corresponding to positions of the first sheet-feed roller and the second sheet-feed roller, the indentation portions being receded away from the slanting surface with respect to the sheet-feed direction.

18. A sheet-feed device as claimed in claim 17, wherein the wall portion further includes a stopper portion positioned between the first sheet-feed roller and the second sheet-feed roller in the axial direction.

19. A sheet-feed device as claimed in claim 18, wherein: the stopper portion is movable between a first position protruding above the slanting surface in a direction opposite the sheet-feed direction and a second position receded below the slanting surface in the sheet-feed direction, the stopper portion moving into the first position and the second position depending on resiliency of the sheet abutting thereagainst.

20. A sheet-feed device as claimed in claim 19, further comprising an urging means for urging the stopper portion into the first position and producing an urging force greater than resiliency of a first sheet type usable in the sheet-feed device and less than resiliency of a second sheet type usable in the sheet-feed device.

* * * * *